United States Patent [19]

Goedde et al.

[11] 4,358,343

[45] Nov. 9, 1982

[54] METHOD FOR QUENCHING COKE

[75] Inventors: Franz Goedde, Stolberg; Rudolf Redlich, Kohlscheid; Johann Riecker, Duesseldorf, all of Fed. Rep. of Germany

[73] Assignee: Hartung, Kuhn & Co. Maschinenfabrik GmbH, Duesseldorf, Fed. Rep. of Germany

[21] Appl. No.: 340,271

[22] Filed: Jan. 18, 1982

Related U.S. Application Data

[63] Continuation-in-part of Ser. No. 169,038, Jul. 15, 1980, abandoned.

[30] Foreign Application Priority Data

Jul. 20, 1979 [DE] Fed. Rep. of Germany ..... 2929385

[51] Int. Cl.[3] ..... C10B 39/04; C10B 39/08; C10B 39/14

[52] U.S. Cl. ..... 201/1; 201/39; 202/227

[58] Field of Search ..... 201/1, 39; 202/227; 422/110

[56] References Cited

U.S. PATENT DOCUMENTS 2,837,470 6/1958 Hayden ..... 202/227
3,794,471 2/1974 Latinen ..... 422/110
3,959,083 5/1976 Goedde et al. ..... 201/39
4,273,617 6/1981 Goedde et al. ..... 201/39

OTHER PUBLICATIONS

Glueckauf-Forschungshefte, vol. 35, No. 3, pp. 108-113 of Jun. 1974 by Erich Szurman et al.

*Primary Examiner*—Bradley Garris
*Attorney, Agent, or Firm*—W. G. Fasse; D. H. Kane, Jr.

[57] ABSTRACT

Preheated bulk material capable of coking is quenched by flowing the quenching liquid through the loose bulk material, whereby the bulk material is substantially closed off relative to the atmosphere. The liquid is applied to the top of the bulk material in a quenching chamber which is closed at its top by a sealed cover and which has an open grating for a horizontal bottom. The steam formed by the quenching liquid and, if formed, any excess quenching liquid are drawn off from the quenching chamber through the open grating. The total quantity of quenching liquid to be supplied as a function of time is controlled by a valve through a control signal depending on the chemical and physical properties constituting bulk material characteristics prior to the heating of the coal. The control signal also takes into account the type of the intended heat treatment in the form of quenching characteristics. In a surprisingly simple embodiment the valve may be controlled by the operation of a cam disk which has a cam surface shaped in accordance with these characteristics.

8 Claims, 6 Drawing Figures

TEMP.
T
[°C]
1000
800
600
400
200
0
$T_i$
VAPOR
PRESSURE
COKE
TEMPERATURE
$T_e$
VAPOR
TEMPERATURE
PRESSURE
P [bar]
0.5
0.4
0.3
0.2
0.1
0
0 10 20 30 40 50 60 70 80 90 100 [s] TIME $P_f$ ; T
TEMPERATURE
[°C]
1000
800
600
400
200
0
$T_f = T_0 e^{\frac{-t}{k}}$ ; $P_f = P_0 \cdot e^{\frac{-t}{k}}$
$\frac{T_0}{e}$
0 40 80 K 120 [s] TIME

FLOW DIAGRAM

METHOD FOR QUENCHING COKE

CROSS-REFERENCE TO RELATED APPLICATION

The present application is a Continuation-In-Part application of our copending U.S. application Ser. No.: 169,038, filed on July 15, 1980, now abandoned.

BACKGROUND OF THE INVENTION

The invention relates to a method for quenching a preheated cokeable bulk material for producing coke. The quenching is achieved by means of a fluid flowing through the preheated bulk material. During the quenching the preheated bulk material is closed off against the atmosphere and the steam formed from the quenching liquid and, if necessary, surplus quenching liquid are drawn off, for example, from the bottom of a quenching chamber. However, surplus liquid is to be avoided.

According to a quenching process known from U.S. Pat. No. 3,959,083 (Goedde et al) the bulk material is treated over a certain period of time nearly uniformly, i.e., a constant quantity of liquid is supplied per unit of time. U.S. Pat. No. 3,959,,083 discloses that in a quenching chamber which is closed at the top there is a physical correlation among the water quantity supplied per unit of time, the vapor pressure and the temperature of vapor escaping at the bottom of the quenching chamber. However, this reference limits the quantity of quenching water supplied per unit of time by stopping the supply when the vapor temperature has been cooled down to an optimal temperature of 400° C. or lower. A direct control of the quenching water supply as a function of the vapor pressure is not disclosed in this reference.

In other conventional quenching processes in which quenching vessels, for example, coke quenching cars are used which are open at the top, the liquid supply is substantially constant per unit of time.

Preheated coking or cokeable bulk material, has very different physical properties depending on the starting raw material coal, and the quality and type of the heat treatment. The quality of the heat treatment depends, for example, on the temperature, the heat capacity and the heat transfer characteristic as well as the heat conductivity and the granular structure of the starting bulk material. In practice there may occur substantial differences in the just mentioned properties depending on the type of starting materials and these differences may affect the quenching results in an undesired manner. Yet, those skilled in the art have accorded to these properties a subordinate significance in the coking or quenching process although these properties may be quantitatively determined. Heretofore the primary concern in the quenching operation was directed to obtaining an absolutely quenched loose material, which, at best, should not exceed a certain remainder moisture content, for example, a moisture content of the quenching liquid as disclosed in said U.S. Pat. No. 3,959,083. Except for stopping the quenching liquid supply as disclosed in U.S. Pat. No. 3,959,083 when a certain vapor temperature has been reached, it is generally customary to treat the preheated loose bulk material freely or rather in an uncontrolled manner with quenching liquid over the whole period of the quenching process.

If the bulk material is preheated cokeable or coking material, substantial variations occur in the properties of the starting material characteristics if the quality of the coal varies, for example, from one coal mine to another. Variations may also result if the operating duration of the furnace, that is the heat treatment, is changed. If the resulting changes in the physical characteristics of the bulk material are not taken into account during the quenching operation, the following disadvantages may arise.

The quenching liquid quantity supplied per unit of time at the beginning of the coke quenching operation may be too large so that the bulk material is initially quenched too much, whereby substantial thermal stresses may occur. Such thermal or heat stresses may cause an extensive destruction of the bulk material to such an extent that an undesirably high proportion of small grained coke and coal slack or breeze is produced.

Further, the water quantity supplied toward the end of the coking operation per unit of time may be too large when the water is supplied as taught in the prior art, whereby certain zones in the bulk material may have a moisture content different from that in other zones of the bulk material. Since the water supply is determined with reference to the zone of the bulk material which is quenched last, other zones of the bulk material receive, toward the end of the quenching operation, liquid quantities which cannot anymore completely evaporate so that it is necessary to provide collecting containers for the excess quenching liquid. Such collecting containers must be equipped with rather expensive purification or cleaning plants. This incomplete evaporation is apparently due to the well known Leidenfrost effect. According to this effect the water drops are insulated from the hot surface of the bulk material by a steam layer which enables the water drops to penetrate deep down into the body of the bulk material. Each drop only explodes when its inner vapor pressure exceeds the surface tension of the drop at a temperature slightly above 100° C.

Further, in prior art quenching operations a relatively large proportion of liquid droplets are entrained by the quenching steam during the introduction of the quenching water. These droplets withdraw heat from the quenching steam when the droplets themselves evaporate. Accordingly, the temperature of the quenching steam drops so that the efficiency of a heat recovery plant connected in series with the quenching plant is not at all economical or such efficiency is too small to be economically significant.

In U.S. Pat. No. 3,959,083 the quenching container is closed at the top. Therefore, the steam pressure that is generated when the quenching liquid is introduced on top of the bulk material under the closed cover, drives the quenching liquid drops and steam down through the body of the bulk material toward the open grating on which the bulk material rests. In the above U.S. Pat. No. 3,959,083 the initial vapor or steam temperature measured at the grating should be 700° C. if no water exits yet from the grating and the initial temperature of the heated bulk material is 1000° C. If these conditions can be maintained throughout the quenching operation, an optimal heat recovery is possible from the quenching operation.

According to the present invention it has been discovered that these initial conditions or rather their equivalents should be maintained throughout the duration of the quenching operation. However, the maintaining of such optimal heat recovery conditions during the entire quenching operation requires that a plurality of parameters are taken into account as will be explained in more detail below. The significance of these parameters has not been recognized heretofore by those skilled in the art.

OBJECTS OF THE INVENTION

In view of the above it is the aim of the invention to achieve the following objects singly or in combination:

to provide a quenching method for heated bulk material in which any thermal stresses are maintained within narrow limits so that the quenched bulk material has a rather uniform grain structure with the smallest possible proportion of fine grained quenched material or slag;

to provide a quenching method which will assure that the quenched bulk material has a uniform moisture content throughout all its zones of the entire batch without producing any substantial excess of quenching liquid;

to substantially avoid the withdrawal of heat from the quenching vapor or steam by any evaporating liquid droplets so that the efficiency of a heat recovery plant connected in series with the quenching plant is still economically feasible;

to control the quenching operation in accordance with the chemical and physical characteristics of the material being quenched and also with due regard to the type of heat treatment to be employed;

to maintain the optimal heat recovery conditions throughout the quenching operation by making sure that the vapor or steam pressure under the cover in the quenching container above the bulk material follows proportionally the decreasing temperature of the bulk material being quenched;

to use the mean or average grain size diameter of the coking material as a control value for controlling the vapor or steam pressure in the container above the bulk material below the closed container cover;

to achieve an optimal coke quenching with a minimal quenching water consumption by controlling the vapor or steam pressure by means of controlling the quantity of water that is sprayed onto the top of the bulk material in such a way that at the beginning of the quenching of a bulk material having an initial temperature of 1000° C. the vapor or steam temperature exiting through the grating does not exceed 700° C. and so that no water exits through the grating; and to cause the vapor or steam pressure to follow the cooling function or characteristic of the bulk material in the quenching container.

SUMMARY OF THE INVENTION

According to the invention there is provided a method for quenching coking bulk material in which the total quantity of the quenching liquid to be supplied is measured as a function of the chemical and physical characteristics of the not yet heated bulk material and in accordance with the type of heat treatment to be used. The supply of the rate of liquid, that is the quantity of liquid per unit of time, is controlled during the quenching operation by a quantity control circuit, whereby the level of the quenching steam pressure in the quenching vessel is used as a control variable. The quenching steam pressure is measured in the quenching chamber above the bulk material below the closed quenching chamber cover which closes the chamber against the atmosphere. However, the quenching chamber is open at the bottom through a horizontally extending grating on which the bulk material rests.

More specifically, the invention provides a method for producing a batch of coke by quenching in a quenching chamber which is closed at the top by a cover and which has an open grating forming a chamber bottom on which the batch of coking bulk material rests, comprising the following steps: ascertaining a first set of data which represent at least one characteristic of the bulk material to be quenched, ascertaining a second set of data which represent at least one quenching characteristic, and indirectly controlling the vapor pressure in the space above the bulk material below the cover as a function of said first and second sets of data by controlling the quantity of quenching liquid supplied per unit of time to the top surface of the bulk material in the quenching chamber below the closed cover so that optimal quenching and heat recovery conditions prevail for the entire duration of the quenching operation, whereby said vapor pressure ranges from about 0.41 bar at the beginning of the quenching to about 0.13 bar at the end of the quenching.

BRIEF FIGURE DESCRIPTION

In order that the invention may be clearly understood, it will now be described by way of example with reference to the accompanying drawings, wherein.

DETAILED DESCRIPTION OF PREFERRED EXAMPLE EMBODIMENTS AND OF THE BEST MODE OF THE INVENTION

Figure 1:
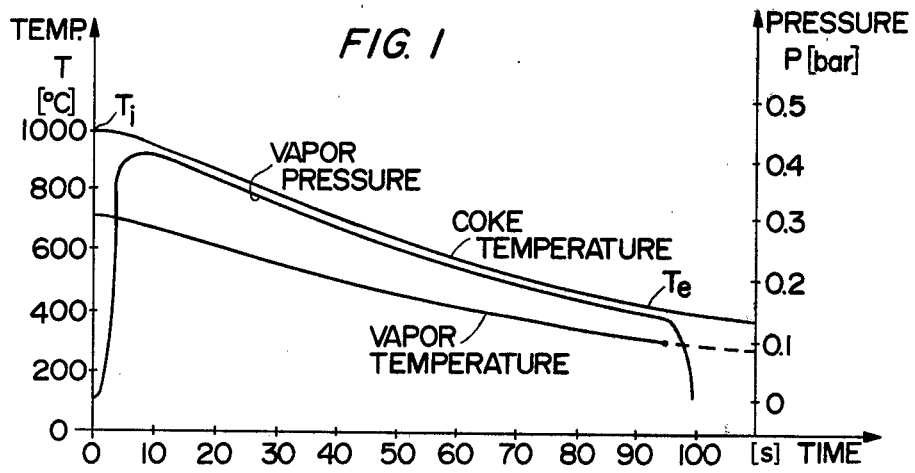
FIG. 1 is a diagram showing the optimal coke temperature, the vapor pressure and the vapor temperature each as a function of time as they occur in practicing the present invention.

FIG. 1 shows three curves. The top curve is the coke temperature curve as a function of the quenching time. It has been found that an optimal heat recovery is possible if the initial temperature of the heated bulk material 1 to be quenched in a quenching chamber 2, has an initial temperature $T_i$ of about 1000° C. at the time when the supplying of quenching water into the quenching chamber 2 begins and if the end temperature $T_e$ of the quenched material is about 400° C. to 500° C. when the quenching is completed.

In order to satisfy this optimal heat recovery condition it is necessary to make sure that the vapor pressure "$P_t$" in the space 3 between the top surface of the bulk material 1 and the chamber cover 4 in the quenching chamber 2 follows the vapor pressure curve shown in FIG. 1. The invention assures this vapor or steam pressure decay or decline as a function of the quenching time by controlling the timed supply of quenching liquid as will be explained in more detail below. The vapor temperature curve shown in FIG. 1 must also decay or decline as shown during the quenching time. The vapor temperature also referred to as the steam temperature is measured at the open grating 5 forming the open bottom in the chamber 2, when no excess water exits through this open grating 5.

It has been found that the just described optimal quenching conditions may be maintained if the control of the quantity or volume of quenching liquid supplied to the top surface of the bulk material takes into account certain facts or data which are characteristic for the bulk material and also further data which are characteristic for the quenching. The bulk material characteristics primarily include the mean or average grain size $d_{50}$ which may be taken from conventional tables or it may be calculated as is disclosed in "GLUECKAUF-FORSCHUNGSHEFTE", Vol. 35, Nr. 3, pages 108 to 113, June 1974 by Erich Szurman et al. A copy of this article is enclosed and incorporated herein by reference. The invention is concerned with using the $d_{50}$ value for the present purposes but not with ascertaining this value.

In addition to the average grain size value $d_{50}$ the set of data representing the bulk material may include the weight W of the batch of bulk material, the flow resistance $R_F$ to the flow of water and steam or vapor through the bulk material, and the filling height H in the quenching chamber. These data may be derived from the $d_{50}$ value as will be explained below. For example the filling height H may be calculated because the dimensions of the quenching chamber 2 are known and constant. The temperatures of the bulk material at various times during the quenching operation may also be included in this set of data.

The set of data representing the quenching characteristics will primarily include the above mentioned vapor pressure, the vapor temperature and the quenching duration. It is actually not important whether the bulk material temperature is included in the first or second set of data.

Figure 2:
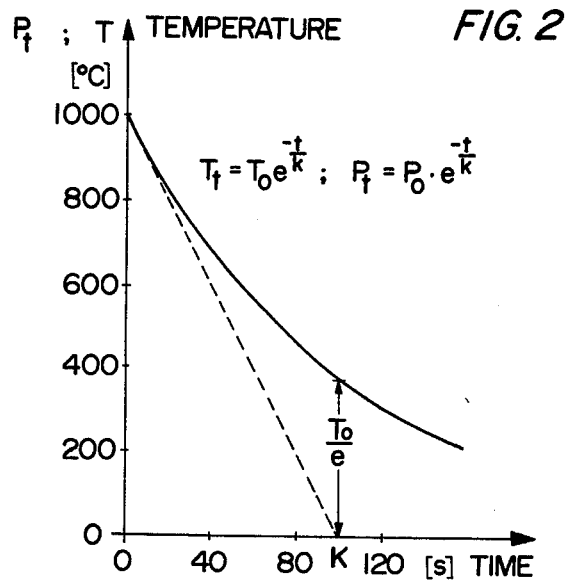
FIG. 2 shows an exponential curve representing the optimal vapor temperature or vapor pressure reduction as a function of the quenching time.

The invention also makes use of the known fact that a given heap or batch of granular bulk material heated to a given starting temperature $T_o$ cools down as a function of time according to the following equation:

$$T_t = T_o \cdot e^{-t/K}$$

which is illustrated in FIG. 2. $T_t$ is an instantaneous temperature value. t is the cool down time and K is a function of the heat capacity of the bulk material and of the heat transfer resistance of the bulk material. It is conventionally referred to as the time constant of the system. "e" is the base of the natural logarithms. If we assume, for example, a time constant K=100 seconds and a starting temperature $T_o$ of 1000° C. then the temperature of the batch of bulk material will decrease or decay within 100 seconds to 1000:e=367° C.

The invention further makes use of the fact that the above cool down function also applies to the pressure reduction or decay of the vapor pressure resulting from the quenching operation. This pressure decay function $P_t$ may thus be expressed as follows:

$$P_t = P_o \cdot e^{-t/K}$$

wherein t is the time and K is the same time constant as mentioned above. $P_o$ is the starting vapor pressure in space 3. This time constant K is ascertained empirically.

It is further known that in a given continuous range or spectrum of grain sizes of the granules forming the bulk material the flow resistance R to a gas or vapor flowing through the granular bulk material is inversely proportional to the mean grain size: $d_{50}$ and directly proportional to the bulk weight or density W.

In addition to the above optimal starting temperatures of 1000° C. for the heated bulk material and 700° C. for the vapor at the grating without water exiting from the grating, the invention teaches that the vapor pressure should decay in accordance with the cool down function of the bulk material for maintaining the optimal heat recovery conditions throughout the quenching operation. The pressure scale is so calibrated that the vapor temperature of 100° C. is equivalent to zero bar (gage) pressure.

In order to avoid measuring the temperature in the bulk material it is sufficient to empirically ascertain the cool down time constant K of the bulk material as explained above. In practice this time constant K is determined as follows. First, the optimal initial vapor pressure in space 3 is established when the above mentioned starting temperatures are measured. This pressure is measured with a conventional pressure gage connected to space 3. Then one may start with an average time constant of, for example, 90 seconds. The time constant is then gradually increased, for example in steps of 5 or 10 seconds, whereby each time the vapor temperature at the open grating 5 is measured until water passes through the grating at a vapor temperature of about 300° C. at the grating. The proper time constant for the system is the value below the last value which resulted in water coming out of the grating because the use of excess quenching water is to be avoided.

Figure 3:
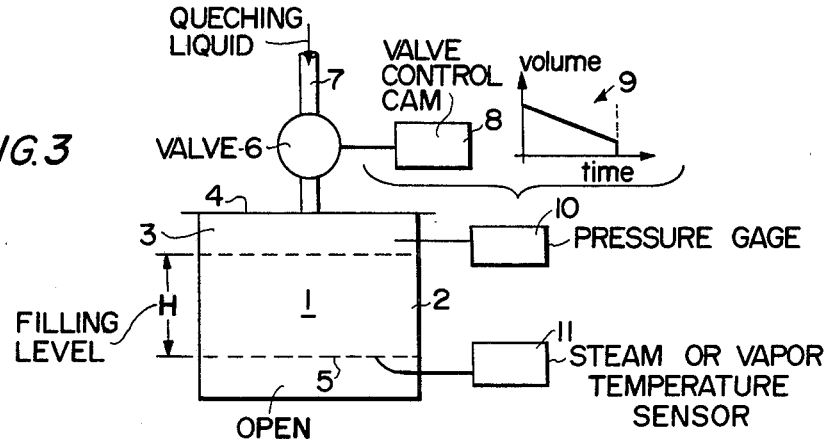
FIG. 3 is a block diagram showing a valve control by means of a cam disk for regulating the quantity of quenching liquid supplied per unit of time in accordance with the invention.

FIG. 3 shows a simple embodiment of the invention in which a valve 6 for the supply of the quenching liquid through the conduit 7 is controlled by a conventional cam disk driven by a valve control member 8 such as a solenoid. The cam disk has such a shape that the described reduction of the supplied volume of quenching liquid as a function of time is assured as shown at 9. The pressure in space 3 is measured with a conventional pressure gage 10. The temperature is sensed by a conventional temperature sensor 11. Once a valve control cam disk has been shaped for taking into account the mean grain size value $d_{50}$ for a given type of coal, the control surface of the cam disk will remain the same. If it is necessary to use a different kind of starting coal having a different $d_{50}$ value, then it is merely necessary to exchange one control cam disk for another valve control cam disk.

Figure 4:
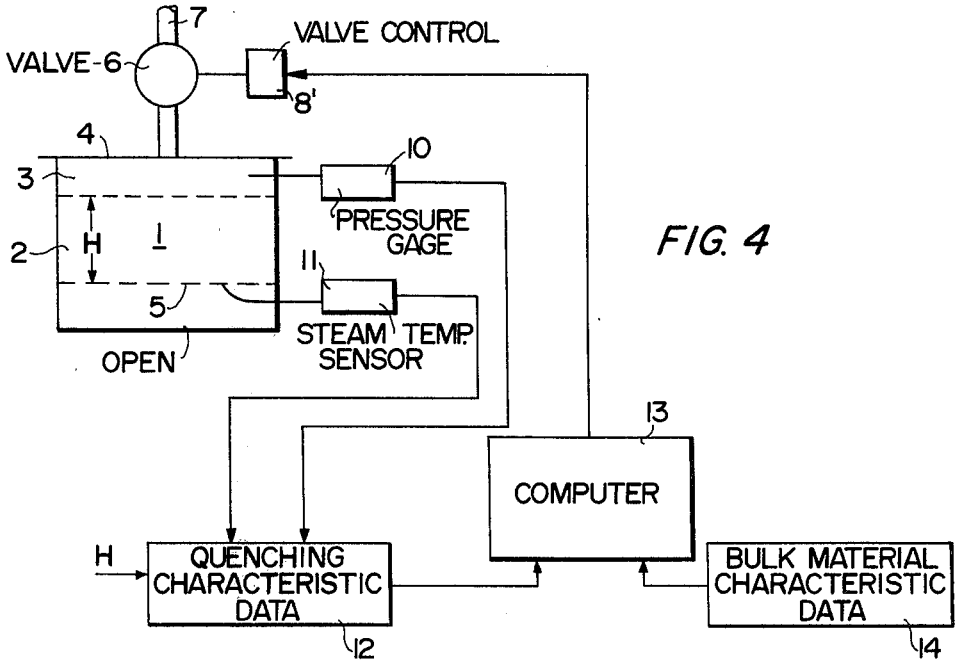
FIG. 4 is a block diagram showing a valve control by means of a computer for regulating the quantity of quenching liquid supplied per unit of time in accordance with the invention.

In FIG. 4 the cam disk valve control of FIG. 3 has been replaced by a computer controlled valve control 8', such as a motor. A computer 13 has input means 12 for receiving quenching characteristic data which may be read by an operator from the gage 10 and sensor 11 and entered through a keyboard. These data may be directly supplied to the computer in the form of respective electrical signals. The computer 13 has another input 14, for example, comprising further input keys for entering bulk material characteristic data into the computer 13. Such data may also be stored in the computer memory. A computer suitable for the present purposes is the Model "System Controller B8010" manufactured by SIEMENS in Munich, Germany.

The computer 13 or the cam disk controller 8 will control the valve opening and closing in such a manner that the above described optimal conditions are maintained until the quenching is completed. The control is primarily based on the $d_{50}$ value which makes sure that the vapor pressure in space 3 decays or declines proportionally to the decreasing temperature of the bulk material. This vapor pressure is thus controlled indirectly by controlling the quenching water supply as a function of time whereby this time function takes the $d_{50}$ value into account.

Figure 5:
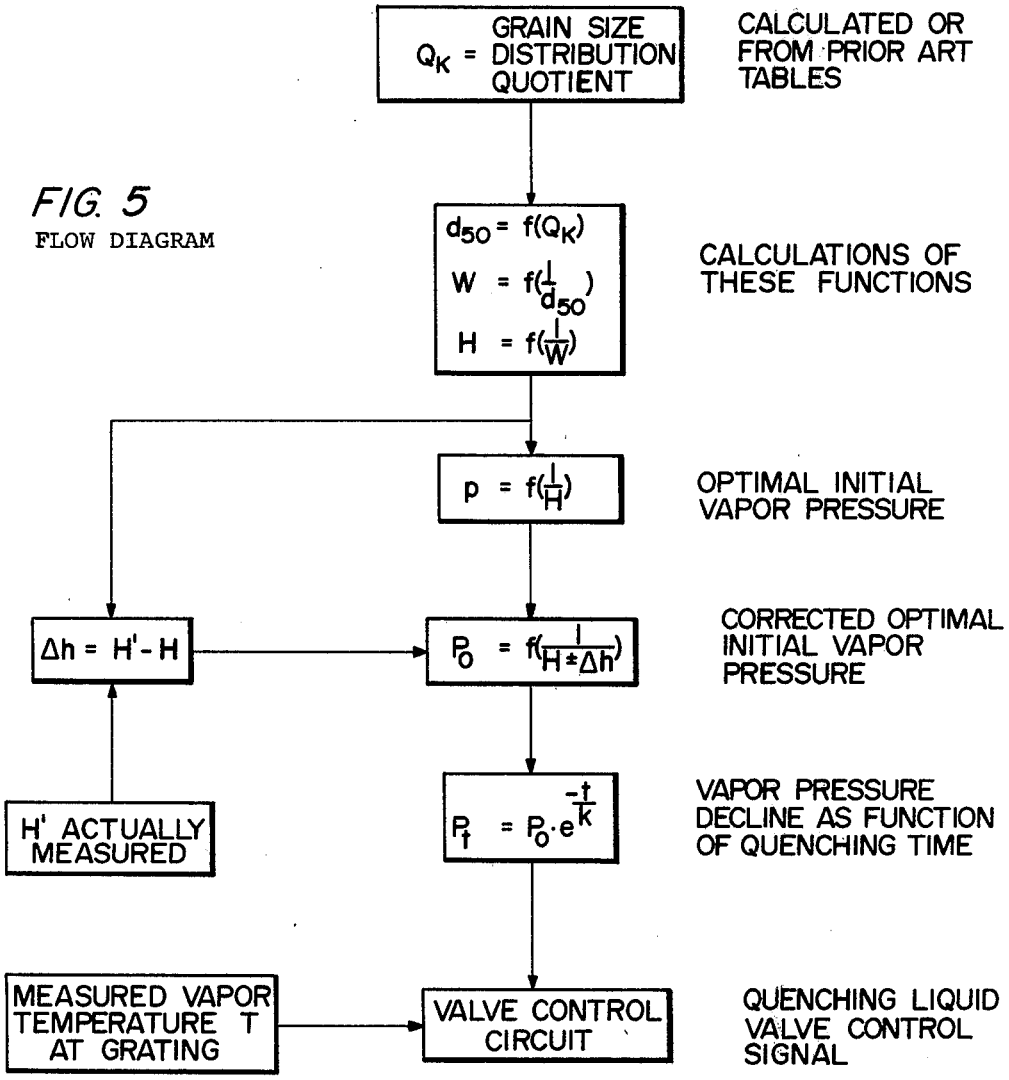
FIG. 5 is a flow diagram for the program steps to be performed by the computer shown in FIG. 4.

FIG. 5 shows a block flow diagram of the functions performed by the computer 13 shown in FIG. 4. The grain size distribution quotient $Q_K$ is ascertained or calculated as described in the above mentioned article by Szurman et al. This quotient may be recalculated on a daily basis. The mean grain size $d_{50}$ is a function of the quotient $Q_K$ and calculated as such by the computer. The weight W of the batch of bulk material is inversely proportional to the $d_{50}$ value, $W=f(1/d_{50})$. The calculated filling level H, see FIG. 3, is inversely proportional to the weight W of the bulk material, whereby the given cross-section dimensions of the quenching chamber 2 are taken into account, $H=f(1/W)$, Hence H is directly proportional to the $d_{50}$ value, $H=f(d_{50})$. The flow resistance R is directly proportional to the weight W, $R=f(W)$ and inversely proportional to the $d_{50}$ value, $R=f(1/d_{50})$. It is also a fact that the flow resistance R decreases as the filling level H increases because the volume of the interstices between the grains increases as the filling level increases. A larger volume of open spaces formed by these interstices decreases the flow resistance. The pressure in the space 3 in turn depends on the flow resistance. Since the latter depends on the filling level there is a relationship between the filling level H and the optimal pressure p in space 3.

The computer calculates this optimal pressure $p=f(1/H)$. This optimal pressure is corrected for any deviations between the calculated filling level H and the actually measured filling level H'. The actual filling level H' of the bulk material in quenching chamber 2 is measured by conventional means not part of the invention. The computer calculates the difference $\Delta h=H'-H$ and corrects the optimal initial vapor pressure accordingly $$P_o = f\left(\frac{1}{H \pm \Delta h}\right).$$

This initial, corrected vapor pressure $P_o$ is then used in the equation for calculating the function for the decline of the vapor pressure to produce a valve control signal. The measured vapor temperature T at the end of the quenching operation is then used to close the valve 6. The just described correction based on filling level variations takes into account any small variations in the characteristics of the bulk material in the coking conditions to which the bulk material has been subjected.

As stated the valve is closed when a given quantity of quenching liquid has been supplied. This is the case when a specified vapor temperature has been reached at the grating 5. For example, if the vapor temperature at the moment of stopping the quenching liquid supply is 300° C. the coke still has a temperature of about 400° C. which has been found to be sufficient to assure a moisture remainder of 2% to 3% (of the water supplied) in the quenched coke batch after a sufficient steam-off time on the ramp.

Figure 6:
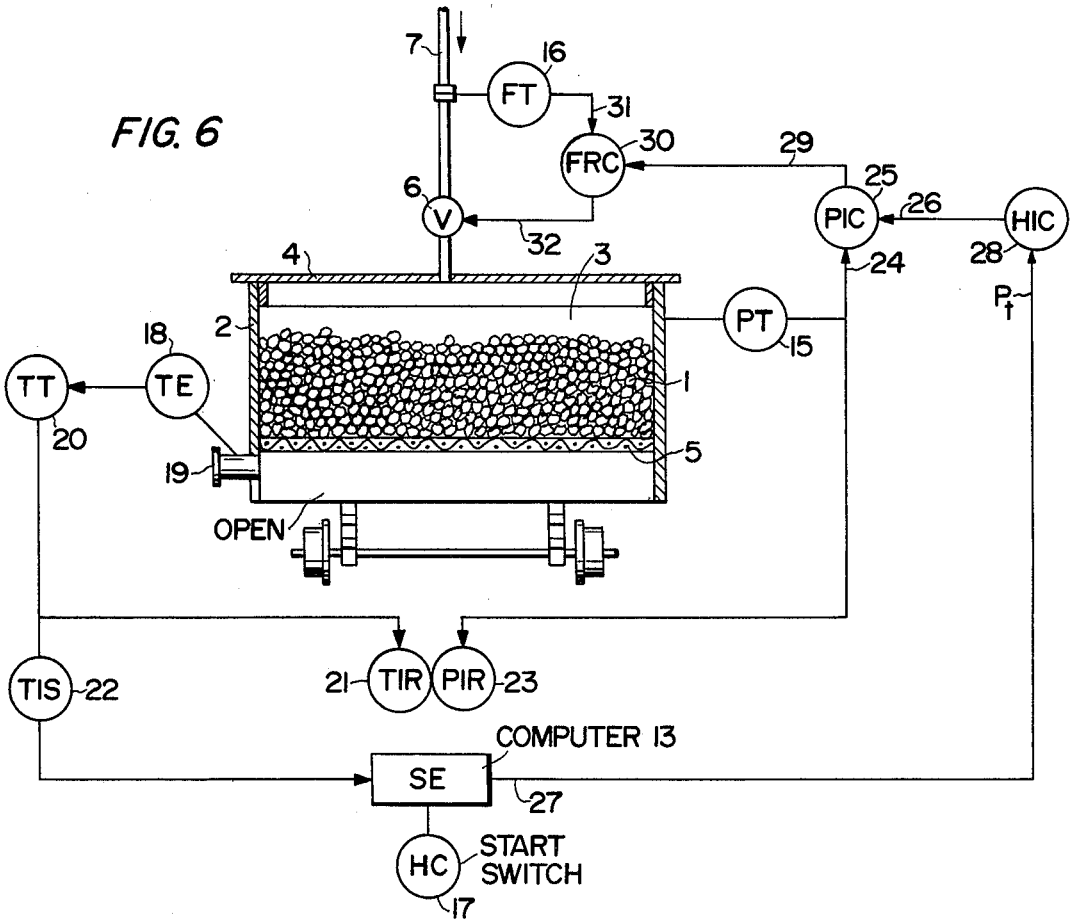
FIG. 6 shows a block circuit diagram of an embodiment of practicing the present invention similar to that of FIG. 4.

FIG. 6 illustrates an example embodiment similar to that of FIG. 4 however, with the additional feature that the valve control signal is further corrected with regard to the actual pressure measured in the space 3 by a pressure transducer 15 and with regard to the actual flow of quenching liquid in the conduit 7 by a flow sensor or transducer 16. As far as the components in FIG. 6 are the same as in FIG. 4, they have the same reference numbers.

The computer 13 receives a start signal through a hand controlled start switch or key 17. The vapor temperature is sensed by a thermoelement 18 at the vapor discharge port 19. A thermostatic switch 20 supplies the electrical signal corresponding to the measured vapor temperature to a temperature recorder 21 and through an operator controlled switch 22 to the computer 13. The pressure transducer 15 is connected to a pressure recorder 23. Recording of the temperature and pressure as a function of the quenching time provides a means for subsequently checking whether the quenching was performed as required. The pressure transducer 15 is also connected to one input 24 of a comparator 25 which receives at its other input 26 the rated pressure signal ($P_t$) from the control output 27 of the computer 13, preferably through an amplifier 28. The comparator 25 produces at its output 29 a first control signal which has been corrected for any deviations between the calculated vapor pressure $P_t$ and the actually measured vapor pressure.

The output 29 is connected to one input of a further comparator 30 which receives at its other input 31 a signal representing the actual flow volume through the conduit 7 as sensed by the flow transducer 16. The comparator 30 produces at its output 32 the final control signal for the valve 6. This final control signal is now also corrected for any variations in the quenching liquid supply, for example in the quenching liquid supply pressure.

The following example shall illustrate an actual quenching operation. The coke 1 of bituminous coal is filled into the quenching chamber 2. At this time the coke has a temperature of 1000° C. The chamber 2 is sealed with the cover 4. The valve 6 is first opened fully and then gradually closed in accordance with the function $P_t=P_o \cdot e^{-t/K}$ as described above. The water evaporates completely under these operating conditions. The resulting vapor flows through the granular bulk material downwardly. The sensible heat of the heated bulk material is converted into evaporation heat, into sensible heat of the resulting quenching vapor, and into sensible heat of the produced water gas. A batch of coking material has a weight of 11000 kg. For such a batch the following figures apply.

| | |
|---|---|
| ash content of the coke | 7.5% by weight |
| starting batch temperature | 1000° C. (coke temperature) |
| quenching stop temperature | 300° C. (vapor temperature) |
| specific heat of the coke: | |
| at 1000° C. and 7.5% ash | 0.353 kcal/kg °C. |
| at 300° C. and 7.5% ash | 0.251 kcal/kg °C. |
| evaporation heat (water) | 539.0 kcal/kg |
| gasification heat of the water gas reaction | 2,175.0 kcal/kg |
| volume of produced water gas | 4.35 $Nm^3$/kg (Carbon) |
| mean or average quenching vapor temperature | 475° C. |
| mean specific heat of the water | |

-continued

| | |
|---|---|
| gas at 475° C. | 0.32 kcal/$Nm^3$ |
| heat content of the quenching vapor at mean temperature of 475° C. | 810 kcal/kg |
| quenching water requirement per kg and carbon gasification | 2 kg $H_2O$/kg of carbon |

Heat quantity to be removed by the quenching liquid for 1000 kg of coke cooled from 1000° C. to 300° C.

1000 kg × 0.35 × 1000° C. − 1000 kg × 0.251 × 300° C. = 277,700 kcal

Less gasification heat (1% of the carbon is converted into water gas by the quenching)

0.01 × 925 kg C × 2.175 kcal/kg = 20,118 kcal

Less sensible heat of the produced water gas.

Water gas quantity produced:

0.01 × 925 kg C × 4.35 $Nm^3$ kg C = 41 $Nm^3$ sensible heat:

$$41\ Nm^3 \times 0.32 \times 475°\ C. = \frac{7{,}692\ kcal}{27{,}810\ kcal} \quad \frac{27{,}810\ kcal}{249{,}890\ kcal}$$

Quenching water required per 1000 kg coke (a) heat removal (quenching):

$$\frac{249{,}890\ kcal}{810\ kcal/kg} = 309.0\ kg\ H_2O$$

(b) gasification reaction (1% of coke gasifies)

0.01 × (1000 − 75) × 2 kg $H_2O$/kg C = 18.5 kg $H_2O$ 75 kg deducted for ash content (7.5%)

a + b = 309 + 18.5 = 327.5 kg $H_2O$/1000 kg coke

Quenching water for one batch of 11 tons of coke

11 × 327.5 kg = 3,602.5 kg/batch.

These 3,602.5 kgs of water are discharged over the top surface of the bulk material 1 within 90 to 100 seconds and in accordance with the above described control function.

Although the invention has been described with reference to specific example embodiments it will be appreciated that it is intended to cover all modifications and equivalents within the scope of the appended claims.

What is claimed is:

1. A method for quenching a batch of coke in a quenching chamber which is closed at the top by a cover and which has an open grating forming a chamber bottom on which the batch of coke rests, comprising the following steps: ascertaining a first set of data which represent at least one characteristic of the coke to be quenched, ascertaining a second set of data which represent at least one quenching characteristic, and indirectly controlling the vapor pressure in the space above the coke below the cover as a function of said first and second sets of data by controlling the quantity of quenching liquid supplied per unit of time to the top surface of the coke in the quenching chamber below the closed cover so that optimal quenching and heat recovery conditions prevail for the entire duration of the quenching operation, whereby said vapor pressure ranges from about 0.41 bar at the beginning of the quenching to about 0.13 bar at the end of the quenching.

2. The method of claim 1, wherein the coke in the quenching chamber has an initial temperature of about 1000° C. when the quenching begins with the admission of quenching liquid to the top surface of the coke, wherein the resulting initial vapor temperature at said grating is about 700° C. without liquid formation at the grating, and wherein after about 96 seconds from the beginning of quenching the vapor temperature reaches about 300° C. and the coke temperature reaches about 400° C., whereby a moisture content of about 2% to 3% by volume of the supplied quenching liquid remains in the quenched coke after evaporation.

3. The method of claim 1, comprising ascertaining said first set of data empirically, ascertaining said second set of data by measurements, shaping a cam disk for the control of a quenching liquid supply valve to have a configuration as determined by said first and second sets of data, and controlling a quenching liquid supply valve with said cam disk in such a manner that the quantity of quenching liquid supplied per unit of time is reduced from a maximum value at the beginning of the quenching operation to zero at the end of a predetermined length of time which begins with the opening of the quenching liquid supply valve and which ends with the complete closing of the valve.

4. The method of claim 1, wherein said first set of data and said second set of data are supplied to a computer which generates a control signal in response to said first and second sets of data, and supplying said control signal to a quenching liquid supply valve for controlling said quenching liquid supply valve so that the quantity of quenching liquid supplied per unit of time is reduced as a function of time from a maximum value at the beginning of the quenching operation to zero at the end of a predetermined length of time which begins with the opening of said quenching liquid supply valve and ends with the closing of the valve.

5. The method of claim 3 or 4, wherein said predetermined length of time is between 90 to 100 seconds.

6. The method of claim 1, wherein said ascertaining of said first set of data comprises providing a value representing the mean grain size ($d_{50}$) of the coke, calculating from said mean grain size an optimal vapor pressure reduction characteristic as a function of time to provide a rated vapor pressure signal, wherein said ascertaining of a quenching characteristic comprises measuring the actual, instantaneous vapor pressure to provide an actual vapor pressure signal, comparing the actual and rated vapor pressure signals with each other to produce a rated first flow control signal, measuring an actual flow rate of quenching liquid to produce an actual flow condition signal, comparing the rated first flow control signal with the actual flow condition signal to produce a second flow control signal, controlling a quenching liquid supply valve with said second flow control signal for reducing the flow of quenching liquid as a function of time, measuring the vapor temperature at the open grating, and stopping the supply of quenching liquid when the vapor temperature has reached a predetermined value.

7. The method of claim 6, wherein said predetermined value of the vapor temperature is about 300° C.

8. The method of claim 7, wherein the coke has an initial temperature of about 1000° C., wherein the initial vapor temperature is about 700° C., whereby said initial vapor pressure of about 0.41 bar is assured, and wherein said predetermined vapor temperature of 300° C. for stopping the supply of quenching liquid assures a quenching time of about 96 seconds at which the final vapor pressure has fallen to said 0.13 bar value.

* * * * *